US005346408A

United States Patent [19]

Chupak

[11] Patent Number: 5,346,408

[45] Date of Patent: Sep. 13, 1994

[54] BATTERY CABLE ASSEMBLY

[75] Inventor: John M. Chupak, West Middlesex, Pa.

[73] Assignee: General Motors Corporation, Detroit, Mich.

[21] Appl. No.: 172,976

[22] Filed: Dec. 27, 1993

[51] Int. Cl.[5] ..... H01R 13/52

[52] U.S. Cl. ..... 439/522; 439/744; 174/138 F

[58] Field of Search ..... 174/138 F; 429/65; 439/202, 519, 521, 522, 523, 744

[56] References Cited

U.S. PATENT DOCUMENTS

| | | | |
|---|---|---|---|
| 1,951,591 | 2/1932 | Anzalone | 173/259 |
| 2,623,085 | 8/1949 | Gier, Jr. | 173/259 |
| 2,906,988 | 9/1959 | Stocking | 439/522 |
| 3,413,593 | 11/1968 | Schaefer | 439/522 |
| 3,775,730 | 11/1973 | Rowls et al. . | |
| 4,572,878 | 2/1986 | Daugherty | 429/62 |
| 4,952,171 | 8/1990 | Sugiyama | 439/522 |
| 5,046,962 | 9/1991 | Sloan et al. | 439/202 |
| 5,169,338 | 12/1992 | Dewar et al. | 439/522 |

*Primary Examiner*—Khiem Nguyen
*Attorney, Agent, or Firm*—William A. Schuetz

[57] ABSTRACT

A battery cable assembly comprising a battery cable having a conductive core and an insulated sheet and a metal cable terminal having a generally forward planar eyelet portion and a rearward crimping portion for securing the terminal to the battery cable and with the eyelet portion having a central through opening and a pair of opposed notches at its sides. The battery cable assembly also includes a plastic, flexible battery terminal cover having a forward portion for slidably receiving the eyelet portion and a rearward portion for receiving the crimping portion of the terminal. The forward portion of the battery terminal cover has a top, bottom, side and end wall portions which define a rectangular slot through which the eyelet terminal can be inserted. The cover also includes a pair of axially extending inwardly facing ribs between the top and bottom which are adapted to be engaged by the eyelet portion to cause deflection of the side wall portions of the cover until the notches in the eyelet portion are aligned with the ribs whereupon the ribs are snap fittingly received within the eyelet portion to connect the eyelet portion to the cover. In addition, the cover is provided with seals for sealing the engaging a side wall of a battery around its terminal and for sealingly engaging a bolt for connecting the eyelet portion to the battery terminal.

5 Claims, 2 Drawing Sheets

FIG-3
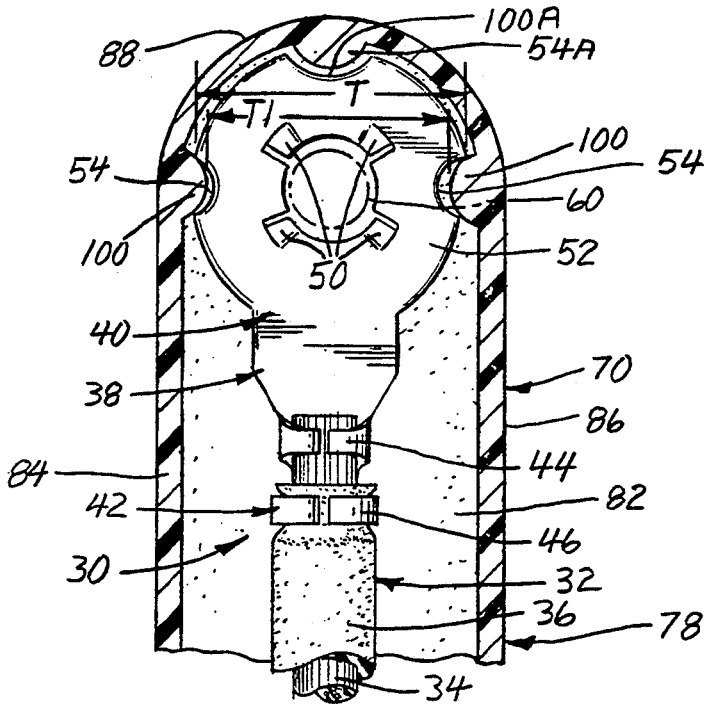
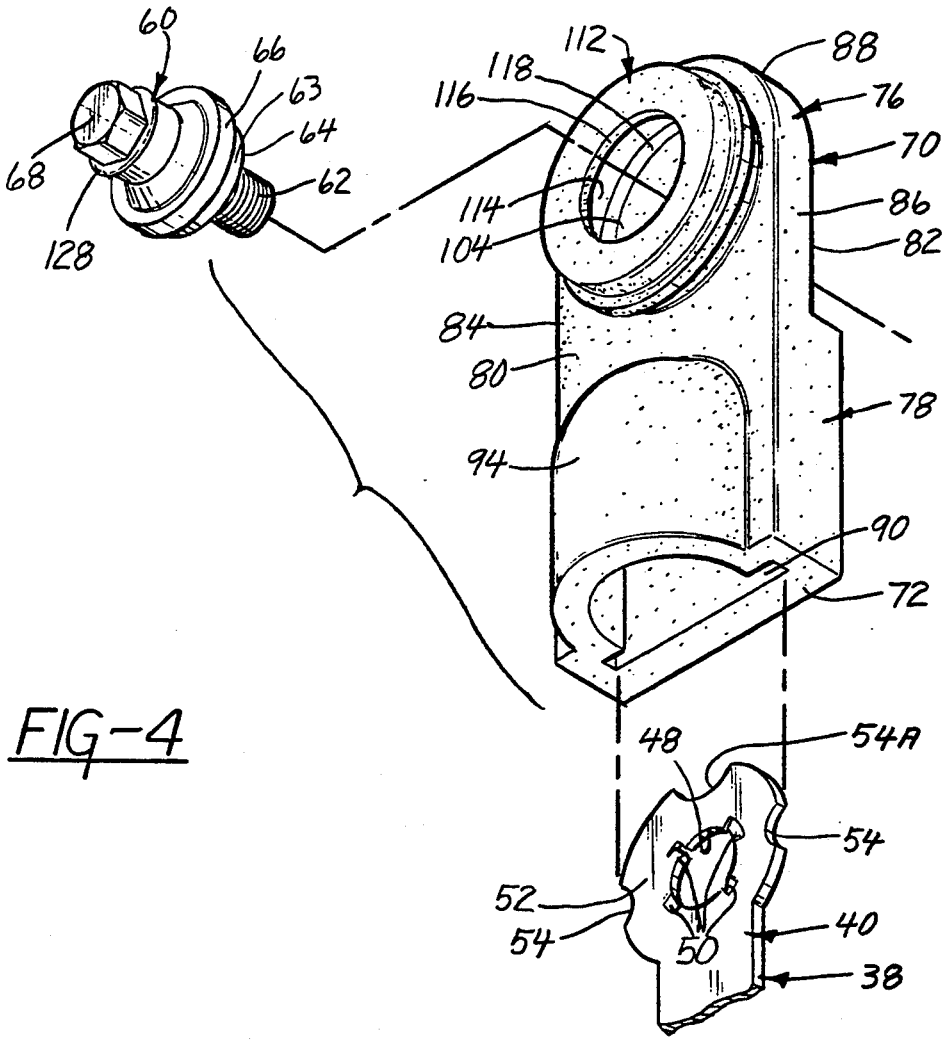
FIG-4

BATTERY CABLE ASSEMBLY

The present invention relates to a battery cable assembly and, more particularly, to a battery cable assembly in which an eyelet terminal crimped to a battery cable is snap fittingly retained in a plastic cover and in which the cover seals around a battery terminal in a battery wall and sealingly engages a battery bolt threadably connected to the battery terminal in the battery wall.

The Packard Electric Division of the General Motors Corporation has for years manufactured battery cable assemblies for side terminal batteries. These cable assemblies comprised an eyelet terminal crimped on to a conductive cable and a terminal cover which was of a vinyl mold-on construction so as to be permanent. This construction also allowed a terminal bolt to be carried by the eyelet terminal for connection with the battery. The mold-on construction included an annular seal surrounding the bolt and battery terminal for sealingly engaging the battery at its side wall around the side battery terminal. Likewise the bolt had a flange which sealingly engaged the mold on cover when tightened to the battery terminal so that a good environmental seal was effected around the connected portions of the bolt and the battery terminal post in the battery. Examples of such battery terminal assemblies can be found in U.S. Pat. Nos. 3,775,730 and 4,572,878, which patents are assigned to the same assignee as the present invention.

While these prior designs have been very successful, they nevertheless required a mold-on operation which was labor intensive and required molding equipment which was fairly expensive.

In accordance with the provisions of the present invention, the mold on design is replaced by a one piece, loose or separate plastic cover which can be snap fittingly connected to the same eyelet cable terminal as previously used in the mold on design and in which the cover provides the same type of sealing engagement with the bolt and the side wall of the battery surrounding the battery terminal therein.

More specifically, the battery cable assembly of the present invention comprises a battery cable having a conductive core and an insulated sheath. It also has a metal cable terminal having a generally forward planar eyelet portion and a rearward crimping portion for securing the terminal to the battery cable. The eyelet portion has a central through opening for receiving a bolt and a pair of opposed notches at its sides. The one piece, snap on cover is molded from a suitable elastomeric or plastic material, such as polypropylene, and has a forward portion for slidably receiving the eyelet portion of the cable terminal and a rearward portion for receiving the crimping portion of the cable terminal.

The forward portion of the battery terminal cover can be defined as having a top, bottom, side and end wall portions which together define a generally rectangular slot for receiving the eyelet portion of the cable terminal. The top and bottom of the forward portion of the cover have aligned through openings and the side wall portions having inwardly facing axially extending ribs between the top and bottom and with the ribs being spaced apart a given transverse distance.

The eyelet portion has a maximum transverse dimension or diameter which is greater than the given distance between the ribs of the cover so that when the eyelet portion is slidably received in the rectangular slot from an insertion end of the cover it engages the ribs and causes the side wall portions of the cover to be deflected from their normal free state position outwardly away from each other in opposition to the self biasing forces of the cover until the notches on the sides of the eyelet portion of the cable terminal are aligned with the ribs whereupon the sides of the cover, due to their self-biasing forces, return toward their normal free state position and with the ribs being received in the notches of the cable terminal with a snap fit to securely retain the terminal and battery cover connected together.

Another feature of the battery cover is that it is provided with an annular ring or grommet portion projecting from its top side which is provided with a radially inwardly extending lip. A battery bolt having a radial flange is adapted to be snap fittingly connected to the grommet by snap fitting or forcing the same past a radially inwardly extending annular lip and with the flange engaging a surface of a cover to provide a seal when it is connected to a battery post. Yet another feature is that the cover is provided with an annular ring projecting away from its bottom which is adapted to be received in an annular recess in the side wall of a side battery terminal to provide a seal between the cover and eyelet portion of the cable terminal and a terminal post in the side wall of the battery. The connection is made by tightening down the bolt which is threadably received in a threaded insert in the battery terminal post so that the annular seal adjacent the bottom of the cover sealingly engages the side wall of the battery terminal surrounding the terminal post in the battery. Likewise the annular flange on the bolt engages an inwardly directed surface on the cover to provide a seal between the bolt flange and cover seal so that a good environmental seal between the flange of the battery bolt and the side wall of the battery surrounding the battery terminal and cable terminal is effected.

In addition a second suitable snap on conventional cover could be provided for surrounding the remaining exterior portion of the battery bolt and with the second cover sealingly engaging the other cover at its top side.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which:

FIG. 3 is a fragmentary cross sectional view taken approximately along the lines 3—3 of FIG. 2; and FIG. 4 is an exploded view of the battery assembly of the present invention.

Figure 1:
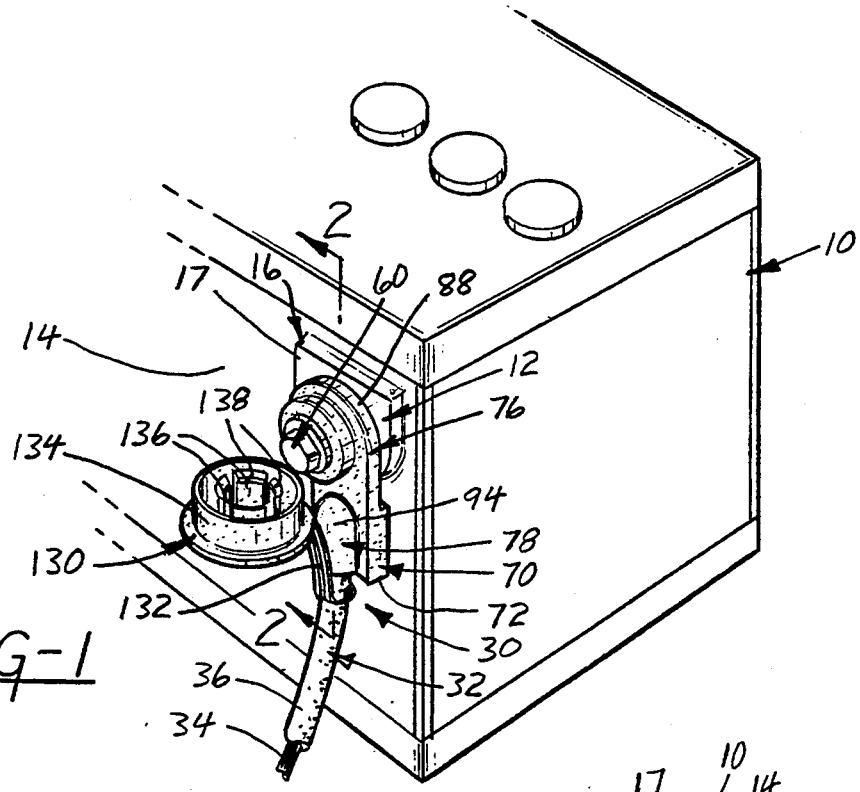
FIG. 1 is a fragmentary perspective view of a side terminal battery and showing the novel battery cable assembly of the present invention connected thereto.
Figure 2:
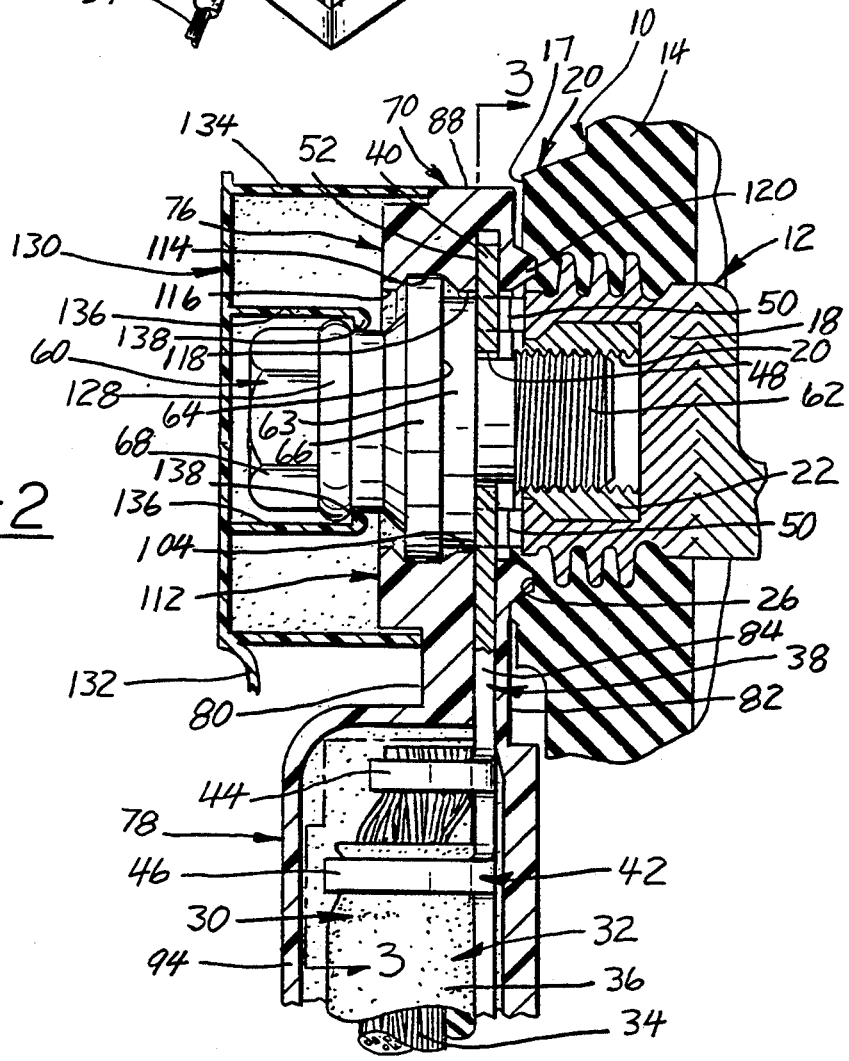
FIG. 2 is an enlarged vertical cross sectional view taken approximately along line 2—2 of FIG. 1, but showing all parts assembly to the battery.

Referring to FIGS. 1 and 2, a battery 10 having a side mounted terminal 12 is thereshown. The battery 10 has a side wall 14 made from a suitable or conventional material such as a composite material that is provided with the side terminal 12. The side wall 14 includes an outwardly projecting mount or portion 16 having a planar end face or surface 17. The terminal 12 includes a suitable plug 18 which is anchored to the side wall 14 and which has an internal opening 20 which receives a threaded insert or nut 22, which is hexagonally shaped. The mounting projection 16 of the side wall 14 of the battery 10 also includes an annular groove 26 facing in the same direction as the end face 17 thereof and which is generally trapezoidally shaped, and for a reason to be hereinafter more fully described.

The battery 10 as described above, is of a conventional construction which has been manufactured for many years by the Delco Remy Division of the General Motors Corporation.

As best shown in FIGS. 1–3, connected to the battery terminal 12 is a cable assembly 30. The cable assembly 30 includes a battery cable conductor 32 having a conductive core 34 and an insulated sheath 36. It further includes a battery cable terminal 38 having a generally flat or planar eyelet portion 40 and a crimping portion 42, including crimping flanges 44, 46 which are adapted to be crimped onto the conductive core 34 and onto the outer sheath 36 of the battery cable conductor 32, respectively. The eyelet portion 40 of the cable terminal 38 has a central through opening 48 and four equally spaced prongs or lanced sections 50 which are bent out of the plane of the eyelet portion 40 and which are adapted to engage the terminal 12 in the battery when connected thereto, as shown in FIG. 2. The eyelet portion 40 at its other or outwardly facing side 52 is planar.

In addition, the eyelet portion 40 has a pair of semicircular shaped notches 54 at its opposite sides which face away from one another. That is, the notches are opposed. The eyelet portion 40 is generally circular, as viewed in FIG. 3, and has a maximum transverse dimension or diameter T, as shown in FIG. 3.

The eyelet portion 40 of the cable terminal 38 is adapted to be connected to the terminal 12 in the side wall 14 of the battery 10 by a bolt 60. The bolt 60 is of a conventional and heretofore used construction and comprises a forward threaded portion 62 which passes through the opening 48 in the eyelet portion 40 of the terminal 38 and which is adapted to be threadably connected to the threaded insert 22, a first radially outwardly extending flange or flange portion 63 defining a shoulder 64 extending radially outwardly of the forward portion 62 and which is adapted to abuttingly engage the planar surface 52 of the eyelet terminal, and a second or large flange or flange portion 66, extending radially outwardly of the shoulder 64 and a tool engaging hex end portion 68 at its other end. The bolt 60 is secured to the terminal by threading the threaded end portion 62 into the threaded insert 22 and with the shoulder 64 abuttingly engaging the side 52 of the eyelet portion 40 to cause the prongs 50 on the eyelet portion 40 to tightly engage the terminal 12 of the battery 10. This provides for both a good electrical and mechanical connection.

In accordance with the provisions of the present invention, a novel one piece cover 70 is provided which can be readily snap fittingly connected to the eyelet portion 40 of the cable terminal 38, which seals the eyelet portion 40 of the cable terminal 38 against the elements and which seals against the housing 14 of the battery 10 surrounding the terminal 12 and which sealingly engages the flange 66 of the bolt 60. The cover 70 is of a one piece plastic or elastomeric material, such as polypropylene and has an open insertion end 72, as viewed in the drawings. The cover 70 has a forward portion 76 for slidably receiving the eyelet portion 40 of the cable terminal 38 and a rearward portion 78 for slidably receiving the crimping portion 42 of the eyelet terminal 38.

The forward portion 76 of the battery terminal cover 70 has a top 80, a bottom 82, side wall portions 84, 86 and a semicircular or rounded end wall portion 88. The top and bottom walls 80, 82 together with the side walls 84, 86 define a rectangular slot 90, as viewed in cross section, for slidably receiving the eyelet portion 40 of the cable terminal 38.

The rearward end portion also includes the bottom 82 and sides 84, 86 and a part of the top 80 of the forward portion 76, further includes an outwardly humped portion 94 for receiving the crimping portion 42 of the connector cable terminal 38.

As best shown in FIG. 3, the side walls 84, 86 of the forward end portion 76 of the cable terminal cover 70 includes a pair of integrally formed ribs 100 which extend inwardly from the side walls 84, 86 and which face towards each other. The ribs 100 are located adjacent the end wall portion 88 and extend axially of the opening 48 in the eyelet portion 40 and extend between the top and bottom walls 80, 82 of the forward portion 76 of the cover 70. It should be noted, that the cover is made of a plastic material which is sufficiently flexible to enable it to flex somewhat. The transverse distance T1 between the innermost points of the ribs 100 is less than the diameter T of the eyelet portion 40 of the cable terminal portion 38. A third locator rib 110A is provided in the end wall portion 88 which is received in a notch 54A in the forward end of the eyelet portion 40 to aid in locating the eyelet portion 40 in the cover 70.

The cover 70 is adapted to be snap fittingly connected to the eyelet portion 40 of the cable terminal 38. This is accomplished by slidably inserting the eyelet portion 40 from the insert end 72 into the slot 90 in the cover 70. The eyelet portion 40 will slide within the slot 90 until it engages the ribs 100 in the cover 70. When this occurs, the ribs 100 and the side walls 84, 86 of the cover 70 will be deflected from their normal free state position, as shown in FIG. 3, away from one another and in opposition to their self-biasing forces until the maximum dimension T of the eyelet portion clears the ribs 100. When this occurs, the self-biasing forces of the sides 84, 86 will cause the ribs 100 to snap fittingly move into the notches 54 in the sides of the eyelet portion 40. When this occurs, the eyelet portion of the cable terminal 38 is securely retained in place within the cover 70. Thus, the cover 70 connects to the eyelet portion 40 of the cable terminal 38 with a snap fit.

As shown in FIG. 2, the forward portion 76 of the cover 70 has a central through opening 104 through which the bolt 60 can pass. The cover 70 also has an integral annular ring or grommet portion 112 extending perpendicular from its upper side 80. The grommet 112 has an annular groove 114 intermediate its ends which communicates with the central opening 104 and defines a pair of annular radially inwardly extending lips or sections 116, 118. The flange 66 on the bolt 60 is adapted to be snap fittingly pushed past the lip 116 and into the annular recess 114, as shown in FIG. 2. This detachably retains the bolt 60 in place in the cover 70 in the eyelet portion 40 of the cable terminal 38.

The cover 70 also has an annular sealing ring 120 (see FIG. 2) projecting away from the bottom surface 82 which is trapezoidally shaped complementary to the shape of the recess 26 in the mounting portion 16 of the side wall 14 of the battery 10. This ring 120 functions as a sealing ring and is received within the recess 26 and sealed against the mounting portion 16 when the bolt 68 is tightened to secure the eyelet portion 40 to the terminal 12 of the battery 10. The flange 66 of the bolt 60 will also sealingly engage the lip or portion 118 when the bolt 60 is tightly drawn onto the battery terminal 12.

It should thus be apparent that a good seal is effected between the underside of the flange 66 of the bolt, the eyelet portion 40, and the battery 10 by use of the novel cover means 70.

It should be noted that the cover 70, as shown in FIGS. 1 and 2, is disposed so that the insertion end 72 is facing vertically down so that the crimping portion 42 of the cable terminal 38 is sealed at its top and sides. Note that the eyelet portion 40 is sealed all around since the top and bottom 80, 82 of the forward portion 76 are clamped against opposite sides of the eyelet portion 40 by the bolt 60 when connected to the battery terminal 12.

In addition, if desired, a novel cap or secondary cover 130 which snap fits over a flange 128 adjacent the hex end 68 of the bolt 60 can be provided to provide a seal between the cover and the remaining portion of the bolt 60. The cover 130 would be connected to the cable conductor 32 via an integral strap 132 and the cover 130 would have an outer circular side wall 134 which engages the top surface 80 of the cover 70. The cover 130 would be connected to the bolt 60 by a plurality of prongs 136 spaced inwardly from the side wall and which have barbs 138 which engage the flange 128 of the bolt 60 and are snap fitted thereover, as shown in FIG. 2, to retain the cover 130 in place against the cover 70.

From the foregoing, it should be apparent that a novel cover 70 has been provided which can be readily snap fittingly connected to a notched eyelet portion 40 of a battery cable terminal 38 and which readily sealingly engages the battery 10 and a bolt 60 for connecting the eyelet portion 40 to the battery 10 to provide a good environmental seal therebetween. The battery cable cover 70 can be produced in ordinary, inexpensive molds.

Although the illustrated embodiment hereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed is defined as follows:

1. A battery cable assembly for connection with a terminal post of a battery comprising:

a battery cable having a conductive core and an insulated sheath, a metal cable terminal having a generally forward planar eyelet portion and a rearward crimping portion for securing said terminal to said battery cable, said eyelet portion having a central through opening and a pair of opposed notches at its sides, a plastic, flexible battery terminal cover having a forward portion provided with a generally rectangular shaped slot for slidably receiving said eyelet portion of said terminal and a rearward portion for receiving said crimping portion of said terminal, said forward portion of said battery terminal cover having aligned openings through its top and bottom sides and having inwardly facing ribs extending axially of said aligned opening and between said top and bottom sides, said eyelet portion having a maximum transverse dimension which is greater than the transverse dimension between said ribs, said ribs being engaged by said eyelet portion of said terminal when said terminal is slidably inserted into the cover and with the eyelet portion causing said ribs to move away from each other and deflect said cover from its normal free state position in opposition to its self biasing forces until the notches on the sides of the eyelet portion are aligned with the ribs whereupon said cover and ribs return toward their normal free state position and with said ribs being received within said notches to retain said cable terminal and battery cover connected together.

2. A battery cable assembly for connection with a battery post of a battery comprising:

a battery cable having a conductive core and an insulated sheath, a metal cable terminal having a generally forward planar eyelet portion and a rearward crimping portion for securing said terminal to said battery cable, said eyelet portion having a central through opening and a pair of opposed notches at its sides, a plastic, flexible battery terminal cover having a forward portion for slidably receiving said eyelet portion of said terminal and a rearward portion for receiving said crimping portion of said terminal, said forward portion of said battery terminal cover having a top, bottom, side and end wall portions, said top and bottom of said forward portion of said cover having aligned through openings and said side wall portions having inwardly facing axially extending ribs between said top and bottom, said ribs being engaged by said eyelet portion of said terminal when said terminal is inserted into the cover and with the eyelet portion causing said side wall portions of said cover to be deflected from their normal free state position away from each other in opposition to the self biasing forces of said cover until the notches on the sides of the eyelet portion are aligned with the ribs whereupon said sides return toward their normal free state position and with said ribs being received within said notches to retain said terminal and battery cover connected together.

3. A battery cable assembly, as defined in claim 2, and including a threaded bolt for securing said eyelet portion of said cable terminal to a battery, said bolt including an enlarged radially extending flange of a given diameter, and wherein said opening in said top has a radially inwardly extending lip whose inner diameter is less than the diameter of said flange on said bolt, said bolt having an attachment end insertable through said opening in said eyelet portion and being connectable to said cover by force fitting said flange thereon past said lip whereby the bolt is connected to said eyelet portion and cover as an assembly.

4. A battery cable assembly, as defined in claim 3, and wherein said bolt adjacent its outer end has a second radially extending flange of a second given diameter, and a cap having a plurality of prongs which are snap fittingly connected to said second flange and with the cap completely surrounding said bolt when connected thereto and engaging said cover to provide a seal around said bolt.

5. A battery cable assembly for connection with a side terminal post of a battery having internal threads and a side battery wall provided with a recess surrounding said terminal post, a battery cable having a conductive core and an insulated sheath, a metal cable terminal having a generally forward planar eyelet portion and a rearward crimping portion for securing said terminal to said battery cable, said eyelet portion having a central through opening and a pair of opposed notches at its sides, a plastic, flexible battery terminal cover having a forward portion for slidably receiving said eyelet portion of said terminal and a rearward portion for receiving said crimping portion of said terminal, said forward portion of said battery terminal cover having a top, bottom, side and end wall portions, said top and bottom of said forward portion of said cover having aligned through openings and said side wall portions having inwardly facing axially extending ribs between said top and bottom, said ribs being engaged by said eyelet portion of said terminal when said terminal is inserted into the cover and with the eyelet portion causing said side wall portions of said cover to be deflected from their normal free state position away from each other in opposition to the self biasing forces of said cover until the notches on the sides of the eyelet portion are aligned with the ribs whereupon said sides return toward their normal free state position and with said ribs being received within said notches to retain said terminal and battery cover connected together, a bolt for clampingly connecting said eyelet portion to said side post of said battery, said cover also having a sealing ring integral with and projecting from its bottom side, said ring being received in said recess in said side wall and sealingly engaging said side wall when said bolt is clamped to said battery post.

* * * * *